US012767896B2

(12) United States Patent
Ballesteros et al.

(10) Patent No.: US 12,767,896 B2
(45) Date of Patent: Oct. 20, 2026

(54) METHOD OF PROCESSING CRUDE OIL AND A REFINED FEEDSTOCK INCLUDING VACUUM RESIDUE, FUEL OIL, OR BOTH

(71) Applicant: Saudi Arabian Oil Company, Dhahran (SA)

(72) Inventors: Alberto Lozano Ballesteros, Dhahran (SA); Abdennour Bourane, Dhahran (SA); Gonzalo Feijoo, Dhahran (SA); Ibrahim Abba, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 226 days.

(21) Appl. No.: 18/652,185

(22) Filed: May 1, 2024

(65) Prior Publication Data

US 2025/0340790 A1 Nov. 6, 2025

(51) Int. Cl.

*C10G 49/22* (2006.01)
*C10G 9/00* (2006.01)
*C10G 69/06* (2006.01)

(52) U.S. Cl.

CPC ..... *C10G 9/005* (2013.01); *C10G 49/22* (2013.01); *C10G 69/06* (2013.01);
(Continued)

(58) Field of Classification Search

CPC ..... C10G 9/005; C10G 49/22; C10G 69/06; C10G 2300/1077; C10G 2300/308; C10G 2300/4081; C10G 2300/708; C10G 2400/20; C10G 51/04; C10G 69/04; C10G 2300/1037; C10G 2400/30; C10G 51/00; C10G 51/06; C10G 69/00; C10G 11/18

See application file for complete search history.

(56) References Cited

U.S. PATENT DOCUMENTS 4,832,823 A * 5/1989 Goyal ..... C10G 51/02 208/50
7,491,315 B2 2/2009 Eng et al.
(Continued)

FOREIGN PATENT DOCUMENTS

ZA 9711637 A 6/1998

OTHER PUBLICATIONS

Notification of Transmittal of the International Search Report and the Written Opinion of the International Searching Authority, or the Declaration dated Jul. 23, 2025 pertaining to International application No. PCT/US2025/024546 filed Apr. 14, 2025, pp. 1-16.
(Continued)

*Primary Examiner* — Ellen M McAvoy
*Assistant Examiner* — Chantel Graham
(74) *Attorney, Agent, or Firm* — Dinsmore & Shohl LLP

(57) ABSTRACT

A method of processing a crude oil feedstock and a refined feedstock comprising vacuum residue and/or fuel oil, the method may comprise: cracking the crude oil feedstock in a downflow reaction zone of a fluid catalytic cracking unit to produce a first FCC product; processing the refined feedstock in a coker to produce a first coker product and a second coker product comprising solid coke; and processing at least a portion of the first FCC product and at least a portion of the first coker product in an upgrading unit to produce an upgraded product stream.

20 Claims, 3 Drawing Sheets

(52) U.S. Cl.
CPC ..... *C10G 2300/1077* (2013.01); *C10G 2300/308* (2013.01); *C10G 2300/4081* (2013.01); *C10G 2300/708* (2013.01); *C10G 2400/20* (2013.01)

(56) References Cited

U.S. PATENT DOCUMENTS

| | | | |
|---|---|---|---|
| 8,361,311 | B2 | 1/2013 | Davis et al. |
| 8,685,232 | B2 | 4/2014 | Mandal et al. |
| 9,096,806 | B2 | 8/2015 | Abba et al. |
| 9,228,140 | B2 | 1/2016 | Abba et al. |
| 9,228,141 | B2 | 1/2016 | Sayed et al. |
| 9,255,230 | B2 | 2/2016 | Shafi et al. |
| 9,279,088 | B2 | 3/2016 | Shafi et al. |
| 9,284,497 | B2 | 3/2016 | Bourane et al. |
| 9,284,501 | B2 | 3/2016 | Sayed et al. |
| 9,284,502 | B2 | 3/2016 | Bourane et al. |
| 9,290,705 | B2 | 3/2016 | Bourane et al. |
| 9,296,961 | B2 | 3/2016 | Shafi et al. |
| 9,382,486 | B2 | 7/2016 | Bourane et al. |
| 10,316,258 | B2 | 6/2019 | Rispoli et al. |
| 10,407,630 | B2 | 9/2019 | Al-Ghamdi et al. |
| 10,472,580 | B2 | 11/2019 | Al-Ghamdi et al. |
| 10,717,941 | B2 | 7/2020 | Al-Ghamdi et al. |
| 10,894,926 | B2 | 1/2021 | Al-Ghamdi et al. |
| 2018/0291291 | A1 | 10/2018 | Brown et al. |
| 2020/0115645 | A1 | 4/2020 | Al-Ghamdi et al. |

OTHER PUBLICATIONS

Lengyel, Attila et al. "Upgrading of Delayed Coker Light Naphtha in a Crude Oil Refinery", Petroleum & Coal, vol. 51, No. 2, Jan. 1, 2009, pp. 80-90.

Magyar, Szabolcs et al. "Hydrodesulfurization and hydroconversion of heavy FCC gasoline on PtPd/H-USY zeolize", Fuel Processing Technology, vol. 86, 2005, pp. 1151-1164.

* cited by examiner

METHOD OF PROCESSING CRUDE OIL AND A REFINED FEEDSTOCK INCLUDING VACUUM RESIDUE, FUEL OIL, OR BOTH

FIELD

The present specification generally relates to processes and systems for converting a crude oil feedstock and a refined feedstock comprising vacuum residue, fuel oil, or both, to petrochemicals and fuel products.

TECHNICAL BACKGROUND

The worldwide increasing demand for light olefins remains a major challenge for many integrated refineries. In particular, the production of some valuable light olefins, such as ethylene and propylene, has attracted increased attention as pure olefin streams are considered the building blocks for polymer synthesis. Additionally, integrated methods and systems for processing a crude oil and a refined feedstock including vacuum residue and/or fuel oil to petrochemicals and fuel products is desired.

SUMMARY

Accordingly, there is an ongoing need for methods of processing crude oil feedstock and a refined feedstock. The methods and systems of the present disclosure include processing a crude oil feedstock and a refined feedstock comprising vacuum residue and/or fuel oil in an integrated method and system. Integration of methods and systems for processing a crude oil and a refined feedstock including vacuum residue and/or fuel oil may reduce capital expenditures and/or operational expenditures compared to conventional methods and systems. Further, such embodiments may reduce the $CO_2$ footprint of such of methods and systems compared to conventional methods and systems.

According to one or more embodiments of the present disclosure a method of processing a crude oil feedstock and a refined feedstock comprising vacuum residue and/or fuel oil, the method may comprise: cracking the crude oil feedstock in a downflow reaction zone of a fluid catalytic cracking unit to produce a first FCC product; processing the refined feedstock in a coker to produce a first coker product and a second coker product comprising solid coke; and processing at least a portion of the first FCC product and at least a portion of the first coker product in an upgrading unit to produce an upgraded product stream.

According to one or more embodiments of the present disclosure, a system for processing a crude oil feedstock and a refined feedstock comprising vacuum residue and/or fuel oil, the system may comprise: a dual downer reactor operable to receive the crude oil feedstock; a first separation unit downstream of the dual downer reactor; a coker operable to receive the refined feedstock; a second separation unit downstream of the coker; and an upgrading unit downstream of the first separation unit; wherein: the second separation unit is fluidly connected to the first separation unit; and the first separation unit is fluidly connected to the coker.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing summary and the following detailed description are merely exemplary, and are intended to provide an overview or framework to understand the nature and character of the claims. The drawings are included to provide a further understanding of the embodiments and, together with the detailed description, serve to explain the principles and operations of the claimed subject matter. However, the embodiments depicted in the drawings are illustrative and exemplary in nature, and not intended to limit the claimed subject matter.

When describing the simplified schematic illustrations of FIG. 2A and FIG. 2B, the numerous valves, temperature sensors, compressors, electronic controllers, pumps and the like, which may be used and are well known to a person of ordinary skill in the art, are not included.

Additionally, the arrows in the simplified schematic illustrations of FIG. 2A and FIG. 2B refer to process streams. However, the arrows may equivalently refer to transfer lines, which may transfer process steams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustrations of FIG. 2A and FIG. 2B may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

BRIEF DESCRIPTION OF THE DRAWINGS

While the specification concludes with claims particularly pointing out and distinctly claiming the subject matter of the description, it is believed that the description will be better understood from the following specification when taken in conjunction with the accompanying drawings, wherein:

DETAILED DESCRIPTION

Figure 1:
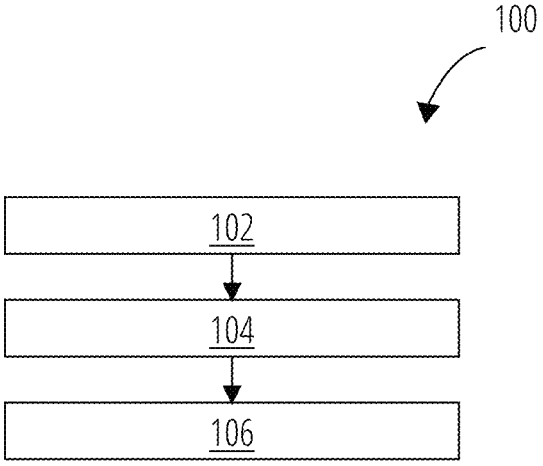
FIG. 1 is a flowchart of a method of processing a crude oil feedstock and a refined feedstock comprising vacuum residue, fuel oil, or both, according to embodiments disclosed herein.

Reference will now be made in detail to embodiments of the present application, various embodiments of which will be described herein with specific reference to the accompanying drawings. Whenever possible, the same reference numerals will be used throughout the drawings to refer to the same or like parts. The present disclosure is directed to methods of processing a crude oil feedstock and a refined feedstock comprising vacuum residue, fuel oil, or both. Such methods may be useful for increasing production of valuable products while reducing capital expenditures, reducing operational expenditures, and/or reducing $CO_2$ footprint compared to conventional methods. Embodiments of the present disclosure may also include systems for processing a crude oil feedstock and a refined feedstock comprising vacuum residue, fuel oil, or both.

In the following detailed description, numerous specific details may be set forth in order to provide a thorough understanding of embodiments described herein. However, it will be clear to one skilled in the art when embodiments may be practiced without some or all of these specific details. In other instances, well-known features or processes may not be described in detail so as not to unnecessarily obscure the disclosure. In addition, like or identical reference numerals may be used to identify common or similar elements. Moreover, unless otherwise defined, all technical and scientific terms used herein have the same meaning as commonly understood by one of ordinary skill in the art to which this disclosure belongs. In case of conflict, the present specification, including the definitions herein, will control.

The term "crude oil" or "crude oil feedstock" as used herein refers to petroleum extracted from geologic formations in its unrefined form. Crude oil suitable as the source material for the processes herein include Arabian Heavy, Arabian Light, Arabian Extra Light, other Gulf crudes, Brent, North Sea crudes, North and West African crudes, Indonesian, Chinese crudes, or mixtures thereof. The crude petroleum mixtures can be whole range crude oil or topped crude oil. As used herein, "crude oil" also refers to such mixtures that have undergone some pre-treatment such as water-oil separation; and/or gas-oil separation; and/or desalting; and/or stabilization. In certain embodiments, crude oil refers to any of such mixtures having an API gravity (ASTM D287 standard), of greater than or equal to about 15°, 20°, 30°, 32°, 34°, 36°, 38°, 40°, 42° or 44°.

The acronym "AXL" as used herein refers to Arab Extra Light crude oil, characterized by an API gravity of greater than or equal to about 38°, 40°, 42° or 44°, and in certain embodiments in the range of about 38°-46°, 38°-44°, 38°-42°, 38°-40.5°, 39°-46°, 39°-44°, 39°-42° or 39°-40.5°.

The acronym "AL" as used herein refers to Arab Light crude oil, characterized by an API gravity of greater than or equal to about 30°, 32°, 34°, 36° or 38°, and in certain embodiments in the range of about 30°-38°, 30°-36°, 30°-35°, 32°-38°, 32°-36°, 32°-35°, 33°-38°, 33°-36° or 33°-35°.

The terms "pyrolysis oil" and its abbreviated form "py-oil" are used herein having their well-known meaning, that is, a heavy oil fraction, C10+, that is derived from steam cracking.

The terms "light pyrolysis oil" and its acronym "LPO" as used herein in certain embodiments refer to pyrolysis oil having an end boiling point of about 440, 450, 460 or 470° C.

The terms "heavy pyrolysis oil" and its acronym "HPO" as used herein in certain embodiments refer to pyrolysis oil having an initial boiling point of about 440, 450, 460 or 470° C.

The term "light cycle oil" and its acronym "LCO" as used herein refers to the light cycle oil produced by fluid catalytic cracking units. The distillation cut for this stream is, for example, in the range of about 220-330° C. LCO is used sometimes in the diesel blends depending on the diesel specifications, or it can be utilized as a cutter to the fuel oil tanks for a reduction in the viscosity and sulfur contents.

The term "heavy cycle oil" and its acronym "HCO" as used herein refer to the heavy cycle oil which is produced by fluid catalytic cracking units. The distillation cut for this stream is, for example, in the range of about 330°-510° C. HCO is used sometimes in an oil flushing system within the process. Additionally, HCO is used to partially vaporize the debutanizer bottoms and then is recycled back as a circulating reflux to the main fractionator in the fluid catalytic cracking unit.

The term "cycle oil" is used herein to refer to a mixture of LCO and HCO.

The term "vacuum gas oil" and its acronym "VGO" as used herein refer to hydrocarbons boiling in the range of about 370-550, 370-540, 370-530, 370-510, 400-550, 400-540, 400-530, 400-510, 420-550, 420-540, 420-530 or 420-510° C.

The term "vacuum residue" and its acronym "VR" as used herein refer to the bottom hydrocarbons having an initial boiling point corresponding to the end point of the VGO range hydrocarbons, and having an end point based on the characteristics of the crude oil feed.

The term "fuel oil" is used herein to refer to an oil fraction obtained from the distillation of crude oil and having a boiling point of greater than about 340° C.

The term "middle distillates" as used herein refer to hydrocarbons boiling in the range of about 170-370, 170-360, 170-350, 170-340, 170-320, 180-370, 180-360, 180-350, 180-340, 180-320, 190-370, 190-360, 190-350, 190-340, 190-320, 200-370, 200-360, 200-350, 200-340, 200-320, 210-370, 210-350, 210-340, 210-320, 220-370, 220-350, 220-340 or 220-320° C.

As used in the present disclosure, the term "directly" refers to the passing of materials, such as an effluent, from a first component of the system to a second component of the system without passing the materials through any intervening components or systems operable to change the composition of the materials. Similarly, the term "directly" also refers to the introducing of materials, such as a feed, to a component of the system without passing the materials through any preliminary components operable to change the composition of the materials. Intervening or preliminary components or systems operable to change the composition of the materials can include reactors and separators, but are not generally intended to include heat exchangers, valves, pumps, sensors, or other ancillary components required for operation of a chemical process. Further, combining two streams together upstream of the second component instead of passing each stream to the second component separately is also not considered to be an intervening or preliminary component operable to change the composition of the materials.

As used in the present disclosure, the terms "downstream" and "upstream" refer to the positioning of components or systems of the system relative to a direction of flow of materials through the system. For example, a second component may be considered "downstream" of a first component if materials flowing through the system encounter the first component before encountering the second component. Likewise, the first component may be considered "upstream" of the second component if the materials flowing through the system encounter the first component before encountering the second component.

As used in the present disclosure, the term "effluent" refers to a stream that is passed out of a reactor, a reaction zone, or a separator following a particular reaction or separation. Generally, an effluent has a different composition than the stream that entered the reactor, reaction zone, or separator. It should be understood that when an effluent is passed to another component or system, only a portion of that effluent may be passed. For example, a slipstream may carry some of the effluent away, meaning that only a portion of the effluent may enter the downstream component or system.

As used in the present disclosure, the term "reactor" refers to any vessel, container, conduit, or the like, in which a chemical reaction, such as catalytic cracking, occurs between one or more reactants optionally in the presence of one or more catalysts. A reactor can include one or a plurality of "reaction zones" disposed within the reactor. The term "reaction zone" refers to a region in a reactor where a particular reaction takes place.

As used in the present disclosure, the terms "separation unit" and "separator" refer to any separation device(s) that at least partially separates one or more chemical constituents in a mixture from one another. For example, a separation system selectively separates different chemical constituents from one another, forming one or more chemical fractions. Examples of separation systems include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, or combinations of these. The separation processes described in the present disclosure may not completely separate all of one chemical constituent from all of another chemical constituent. Instead, the separation processes described in the present disclosure "at least partially" separate different chemical constituents from one another and, even if not explicitly stated, separation can include only partial separation.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "crude oil feedstock" passing to a first system component or from a first system component to a second system component should be understood to equivalently disclose "crude oil" passing to the first system component or passing from a first system component to a second system component.

The composition of feed streams and processing variables of FCC systems play a significant role on the reaction yields and heat balance within the systems. Conventional FCC systems and processes can require costly refining to produce suitable feed streams. Such additional costly refining can include separating and processing of one or more fractions of a hydrocarbon feedstock before introducing the refined conventional feed into the FCC system. These additional processing steps are energy intensive and reduce the amount of viable feed from an existing hydrocarbon source. Further, processing vacuum residue and/or fuel oil to produce upgraded products may not be economically viable in some conventional systems.

Accordingly, aspects of the present disclosure are directed to methods and systems for converting crude oil directly to greater value chemical products and intermediates, and converting vacuum residue and/or fuel oil to greater value chemical products and intermediates while reducing the $CO_2$ footprint by capturing and storing $CO_2$ in the form of solid coke. Such integrated methods and systems may reduce capital expenditures, reduce operation expenditures, or both.

Referring now to FIG. 1, a method 100 of processing a crude oil feedstock and a refined feedstock comprising vacuum residue, fuel oil, or both is depicted. The method 100 may comprise cracking the crude oil feedstock in a downflow reaction zone of a fluid catalytic cracking unit to produce a first FCC product, at block 102; processing the refined feedstock in a coker to produce a first coker product and a second coker product comprising solid coke, at block 104; and processing at least a portion of the first FCC product and at least a portion of the first coker product in an upgrading unit to produce an upgraded product stream, at block 106.

As shown in the method 100 of FIG. 1, the method may comprise cracking the crude oil feedstock in a downflow reaction zone of a fluid catalytic cracking unit to produce a first FCC product, at block 102.

The crude oil may have an American Petroleum Institute (API) gravity of from 15 degrees to 50 degrees, such as from 20 degrees to 50 degrees, from 20 degrees to 40 degrees, from 20 degrees to 35 degrees, from 25 degrees to 50 degrees, from 25 degrees to 40 degrees, from 25 degrees to 35 degrees, from 30 degrees to 50 degrees, or from 30 degrees to 40 degrees. For example, the crude oil feedstock can be an Arab Light (AL) crude oil, an Arab Extra Light (AXL) crude oil, or combinations thereof. The crude oil feedstock can have a density of greater than 0.8 grams per milliliter (g/mL), greater than 0.82 g/mL, greater than 0.84 g/mL, or even greater than 0.85 g/mL as measured at 15 degrees Celsius. In embodiments, the crude oil feedstock can have a density of less than or equal to 1.0 g/mL, less than or equal to 0.95 g/mL, less than or equal to 0.90 g/mL, or even less than or equal to 0.88 g/mL as measured at 15 degrees Celsius. In embodiments, the crude oil feedstock is Arab light crude oil and Arab Extra Light crude oil.

The crude oil feedstock may be a crude oil that has undergone at least some processing, such as desalting, solids separation, scrubbing, or combinations of these, but has not been subjected to distillation. For instance, the crude oil feedstock can be a de-salted crude oil that has been subjected to a de-salting process. In embodiments, the crude oil feedstock can include a crude oil that has not undergone pretreatment, separation (such as distillation), or other operation that changes the hydrocarbon composition of the crude oil prior to introducing the crude oil to the fluid catalytic cracking unit. As used herein, the "hydrocarbon composition" of the crude oil feedstock refers to the composition of the hydrocarbon constituents of the crude oil feedstock and does not include entrained non-hydrocarbon solids, salts, water, or other non-hydrocarbon constituents.

In embodiments, the crude oil feedstock can be a crude oil having an initial boiling point temperature of greater than or equal to 30° C., such as from 30° C. to 50° C., or from 30° C. to 40° C., as determined according to standard test method ASTM D7169. In embodiments, the crude oil feedstock can be a crude oil having an end boiling point temperature greater than 720° C., as determined according to standard test method ASTM D7169. In embodiments, the crude oil feedstock can be a crude oil having a 50% boiling point temperature greater than 300° C., such as from 300° C. to 400° C., from 300° C. to 380° C., from 300° C. to 375° C., from 350° C. to 400° C., from 350° C. to 380° C., from 350° C. to 375° C., from 360° C. to 400° C., from 360° C. to 380° C., or even from 360° C. to 375° C., as determined according to standard test method ASTM D7169.

In embodiments, the crude oil feedstock can have a concentration of paraffin compounds of less than 50 wt. %, such as less than or equal to 40 wt. %, less than or equal to 35 wt. %, less than or equal to 30 wt. %, less than or equal to 25 wt. %, or even less than or equal to 20 wt. % per unit weight of the hydrocarbon feed, as determined according to ASTM 5443. In embodiments, the crude oil feedstock can have a concentration of paraffin compounds of from 5 wt. % to less than 50 wt. %, from 5 wt. % to 40 wt. %, from 5 wt. % to 35 wt. %, from 5 wt. % to 30 wt. %, from 5 wt. % to 25 wt. %, from 5 wt. % to 20 wt. %, from 10 wt. % to less than 50 wt. %, from 10 wt. % to 40 wt. %, from 10 wt. % to 35 wt. %, from 10 wt. % to 30 wt. %, from 10 wt. % to 25 wt. %, or even from 10 wt. % to 20 wt. % per unit weight of the crude oil feedstock.

In embodiments, the crude oil feedstock can have a concentration of aromatic compounds of greater than or equal to 20 wt. %, greater than or equal to 30 wt. %, greater than or equal to 40 wt. %, or even greater than or equal to 50 wt. % per unit weight of the crude oil feedstock, as determined according to ASTM 5443. In embodiments, the crude oil feedstock can have a concentration of aromatic compounds of from 20 wt. % to 90 wt. %, from 20 wt. % to 80 wt. %, from 20 wt. % to 70 wt. %, from 30 wt. % to 90 wt. %, from 30 wt. % to 80 wt. %, from 30 wt. % to 70 wt. %, from 40 wt. % to 90 wt. %, from 40 wt. % to 80 wt. %, from 40 wt. % to 70 wt. %, from 50 wt. % to 90 wt. %, from 50 wt. % to 80 wt. %, or even from 50 wt. % to 70 wt. % per unit weight of the crude oil feedstock.

In embodiments, the crude oil feedstock can have a concentration of naphthenes of greater than or equal to 25 wt. %, or even greater than or equal to 27 wt. % per unit weight of the hydrocarbon feed 102, as determined according to ASTM 5443. In embodiments, the crude oil feedstock can have a concentration of naphthenes of from 25 wt. % to 60 wt. %, from 25 wt. % to 50 wt. %, from 25 wt. % to 40 wt. %, from 25 wt. % to 35 wt. %, from 27 wt. % to 60 wt. %, from 27 wt. % to 50 wt. %, from 27 wt. % to 40 wt. %, or even from 27 wt. % to 35 wt. % per unit weight of the crude oil feedstock.

In embodiments, the crude oil feedstock can be a topped crude oil. As used in the present disclosure, the term "topped crude oil" refers to crude oil from which lesser boiling constituents have been removed through distillation, such as constituents having boiling point temperatures less than 180° C. or even less than 160° C. In embodiments, the crude oil feedstock comprises, consists of, or consists essentially of a topped crude oil, which has greater than or equal to 95%, greater than or equal to 98%, or even greater than or equal to 99% constituents having boiling point temperatures greater than or equal to 160° C. or greater than or equal to 180° C., depending on the cut point temperature of the topping unit.

The fluid catalytic cracking unit may include one or more reactors, such as a downflow reactor comprising a downflow reaction zone. In embodiments, the fluid catalytic cracking unit may include two or more downflow reactors and a regenerator zone operable to receive a spent catalyst from one or more downflow reactors and to regenerate the spent catalyst. A general description of a dual downer reactor unit is provided in U.S. Pat. No. 9,290,705, the complete disclosure of which is incorporated herein by reference. In embodiments, the fluid catalytic cracking unit may be operated with a catalyst-to-oil ratio of greater than or equal to 15:1. In embodiments, flue gases may be separately removed from the fluid catalytic cracking unit.

The first FCC product may comprise light olefins (e.g. ethylene and/or propylene), dry gases, butenes, _LPG, cracked gasoline, light cycle oil, heavy cycle oil, or combinations thereof.

The method 100 may comprise fractionating the first FCC product to produce one or more FCC fractions that may be subsequently processed.

The first FCC product may be fractionated by composition and/or temperature cut. For instance, the method 100 may comprise at least one of: fractionating the first FCC product to produce a first fraction comprising, light cycle oil, heavy cycle oil, or combinations thereof; fractionating the first FCC product to produce a second fraction comprising butenes and butanes, $C_{5+}$ hydrocarbons having a boiling point of less than or equal to 220° C., or combinations thereof; fractionating the first FCC product to produce a third fraction comprising ethane, propane, butane, or combinations thereof; fractionating the first FCC product to produce a fourth fraction comprising methane, hydrogen, $H_2S$, or combinations thereof; and fractionating the first FCC product to produce a fifth fraction comprising light olefins. It should be understood that the number used to characterize the FCC fraction (e.g. fifth fraction) does not require the first FCC product to be fractionated into that specific number of streams. For instance, in embodiments, the first FCC product may be fractionated into two, three, four, five, six, or greater than six fractions and may include any combination of the fractionating steps and FCC fractions formed therefrom. That is, in some embodiments, the method 100 may include fractionating the first FCC product 206 to produce at least two fractions, such as the first fraction and the second fraction, fractionating the first FCC product 206 to produce at least three fractions, such as the first fraction, the second fraction, and the third fraction, or fractionating the first FCC product to produce at least four fractions, such as the first fraction, the second fraction, the third fraction, and the fifth fraction.

In embodiments, the first fraction may comprise hydrocarbons having a boiling point of great than 220° C., such as, light cycle oil, heavy cycle oil, or combinations thereof. In embodiments, greater than or equal to 50 wt. %, 60 wt. %, 70 wt. %, 80 wt. %, 90 wt. %, 95 wt. %, or 99 wt. % of the first fraction may comprise light cycle oil, heavy cycle oil, or combinations thereof, based on the total weight of the first fraction.

Subsequent to the fractionating of the first FCC product, the first fraction comprising, light cycle oil, heavy cycle oil, or combinations thereof may be further processed.

In embodiments, the method may comprise thermally cracking the first fraction to produce a cracked products stream comprising hydrogen, light olefins, LPG, pyrolysis gasoline, pyrolysis fuel oil, or combinations thereof. The first fraction may be thermally cracked using steam cracking. In embodiments, the first fraction may be heated at a temperature of from 400° C. to 900° C., such as from 450° C. to 850° C., from 500° C. to 800° C., from 550° C. to 750° C., from 600° C. to 700° C., or from any and all ranges and sub-ranges between the foregoing values.

In embodiments, at least a portion of the cracked products stream may be passed to the coker. The cracked products stream may be separated into two or more streams prior to introducing at least one of the streams to the coker. In embodiments, subsequent to the separating of the cracked products stream, at least one of the streams may be recycled upstream in the method 100, such as combining a recycled stream separated from the cracked products stream with the first FCC product prior to additional fractionation of the first FCC product.

In embodiments, the first FCC product may be fractionated to produce the first fraction, and the first fraction may be passed to the coker. That is, in some embodiments, the first fraction may not be thermally cracked, and instead may be passed to the coker after the fractionating. In such embodiments, the method 100 may further comprise removing cracked gas oil, cracked vacuum gas oil, or both from the first fraction prior to passing the first fraction to the coker.

In embodiments, greater than or equal to 50 wt. %, 60 wt. %, 70 wt. %, 80 wt. %, 90 wt. %, 95 wt. %, or 99 wt. % of the second fraction may comprise $C_{4+}$ hydrocarbons having a boiling point of less than or equal to 220° C., based on the total weight of the first fraction. Subsequent to the fractionating of the first FCC product, the second fraction may be further processed. At least a portion of the second fraction may be passed to the upgrading unit.

In embodiments, greater than or equal to 50 wt. %, 60 wt. %, 70 wt. %, 80 wt. %, 90 wt. %, 95 wt. %, or 99 wt. % of the third fraction may comprise ethane, propane, butane, or combinations thereof. Subsequent to the fractionating of the first FCC product, the third fraction may be further processed. The third fraction may be sent to a gas steam cracker for production of light olefins and other hydrocarbons.

In embodiments, greater than or equal to 50 wt. %, 60 wt. %, 70 wt. %, 80 wt. %, 90 wt. %, 95 wt. %, or 99 wt. % of the fourth fraction may comprise hydrogen. Subsequent to the fractionating of the first FCC product, the fourth fraction may be stored or integrated into a separate plant system. Without intending to be bound by any particular theory, it is believed that hydrogen gas may be produced and separated from the methods and systems disclosed herein, which may increase profitability of such systems.

In embodiments, greater than or equal to 50 wt. %, 60 wt. %, 70 wt. %, 80 wt. %, 90 wt. %, 95 wt. %, or 99 wt. % of the fifth fraction may comprise light olefins. Subsequent to the fractionating of the first FCC product, the fifth fraction may be stored or integrated into a separate plant system.

As shown in the method 100 of FIG. 1, the method may comprise processing the refined feedstock in a coker to produce a first coker product and a second coker product comprising solid coke, at block 104.

The refined feedstock may comprise from 0 wt. % to 100 wt. % vacuum residue, such as from 10 wt. % to 90 wt. %, from 20 wt. % to 80 wt. %, from 30 wt. % to 70 wt. %, from 40 wt. % to 60 wt. %, from 45 wt. % to 50 wt. %, or from any and all ranges and sub-ranges between the foregoing values, based on the total weight of the refined feedstock.

The refined feedstock may comprise from 0 wt. % to 100 wt. % fuel oil, such as from 10 wt. % to 90 wt. %, from 20 wt. % to 80 wt. %, from 30 wt. % to 70 wt. %, from 40 wt. % to 60 wt. %, from 45 wt. % to 50 wt. %, or from any and all ranges and sub-ranges between the foregoing values, based on the total weight of the refined feedstock.

In embodiments, the first coker product may comprise hydrogen and hydrocarbons, such as light gases, coker naphtha, coker gas oil, coke, or combinations thereof.

The method 100 may include fractionating the first coker product to produce a first coker fraction comprising hydrogen and hydrocarbons having a boiling point of less than or equal to 220° C., and a second coker fraction comprising hydrocarbons having a boiling point of greater than 220 C. Without intending to be bound by any particular theory, it is believed that by fractionating the first coker product, hydrogen, light olefins, and/or other hydrocarbons may be recovered from the coker.

In embodiments, at least a portion of the hydrogen may be removed from the first coker product to produce a hydrogen-depleted first coker product. The hydrogen-depleted first coker product may be passed to the upgrading unit for further processing. In embodiments, the first coker product may be recycled upstream of the method 100, such that the first coker product may be combined with the first FCC product prior to additional fractionation of the first FCC product.

The method 100 may further comprise recycling at least a portion of the second coker fraction to the coker. In such embodiments, the method 100 may also comprise mixing at least a portion of the second coker fraction with the refined feedstock upstream of the coker.

In embodiments, the method 100 may comprise separating the second coker product comprising solid coke from the first coker product prior to fractionating the first coker product. The second coker product comprising solid coke may be disposed or stored.

As shown in the method 100 of FIG. 1, the method may comprise processing at least a portion of the first FCC product and at least a portion of the first coker product in an upgrading unit to produce an upgraded product stream, at block 106.

In embodiments, at least a portion of the first FCC product processed in the upgrading unit may include at least a portion of the second fraction, as described in reference to block 102.

In embodiments, at least a portion of the first coker product processed in the upgrading unit may include at least a portion of the first coker fraction, as described in reference to block 104.

Figure 2A:
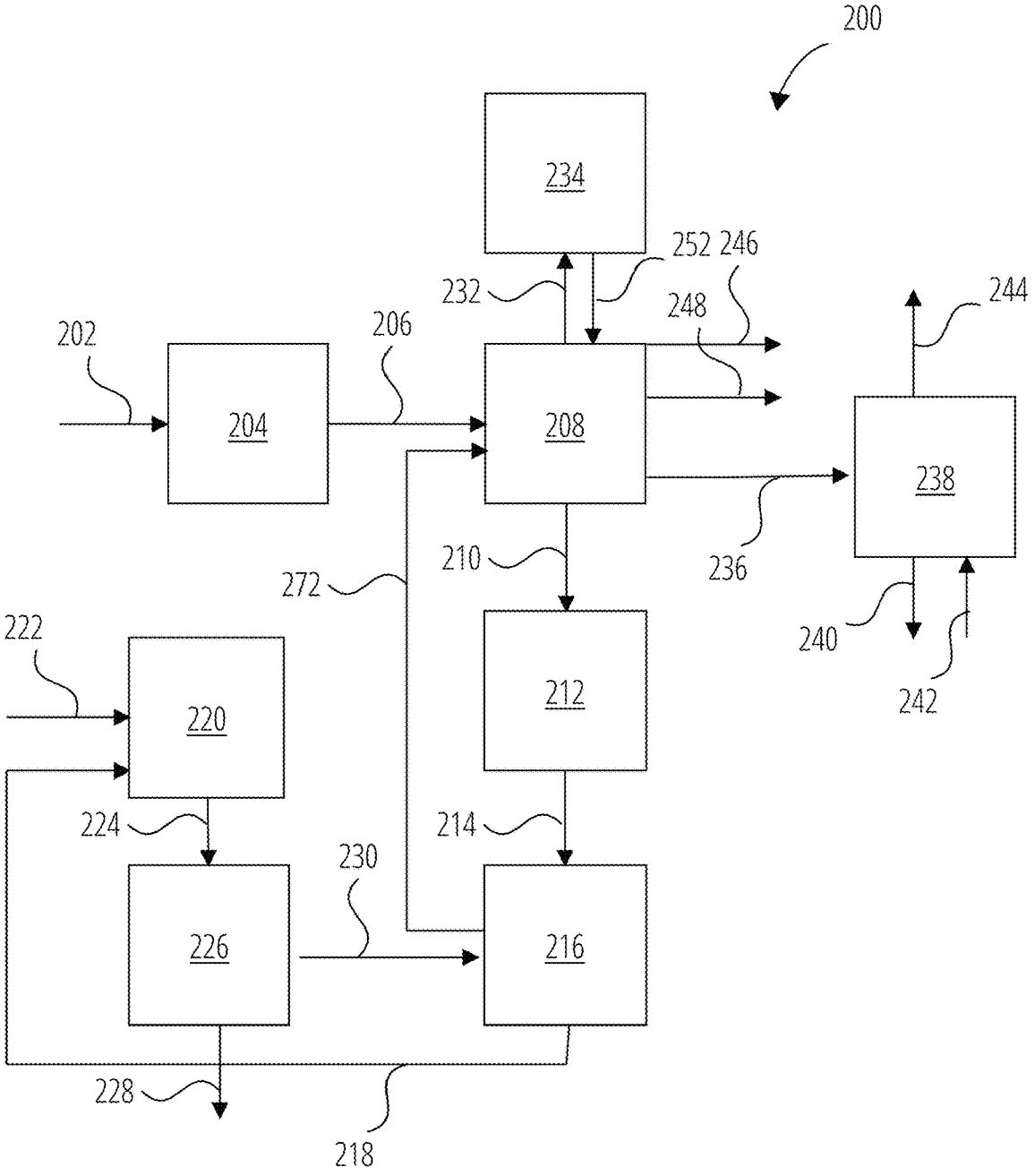
FIG. 2A schematically depicts a system for processing a crude oil feedstock and a refined feedstock comprising vacuum residue, fuel oil, or both, according to embodiments disclosed herein.

Referring now to FIG. 2A, a system 200 for processing a crude oil feedstock 202 and a refined feedstock 222 comprising vacuum residue, fuel oil, or both, is depicted. Any description of like terms used in the context of the method 100 may apply to the same terms used in the system 200. For instance, any description of the "crude oil feedstock" in the method 100 may apply to the "crude oil feedstock 202" of the system 200.

As shown in FIG. 2A, the crude oil feedstock 202 may be passed to a dual downer reactor 204, producing a first FCC product 206. The dual downer reactor 204 may be operable to receive the crude oil crude oil feedstock 202. As previously incorporated herein in its entirety, the dual downer reactor 204 may include any configuration provided in U.S. Pat. No. 9,290,705. In embodiments, flue gases may be removed from the dual downer reactor 204 (not shown).

The first FCC product 206 may be passed to a first separation unit 208. The first separation unit 208 may be downstream of the first separation unit 208. The first separation unit 208 may be operable to fractionate the first FCC product 206 into two or more fractions. The first separation unit 208 may be operable to fractionate the first FCC product 206 into a first fraction 210 comprising light cycle oil, heavy cycle oil, or combinations thereof, a second fraction 236 comprising butenes, $C_{5+}$ hydrocarbons having a boiling point of less than or equal to 220° C., or combinations thereof, a third fraction 232 comprising ethane, propane, butane, or combinations thereof, a fourth fraction 246 comprising methane, hydrogen, $H_2S$, a fifth fraction 248 comprising light olefins, or any combination thereof.

The first fraction 210 may be passed to a furnace 212 operable to thermally crack the first fraction 210, thereby producing a cracked products stream 214. In embodiments, the furnace 212 may be heated at a temperature of from 400° C. to 900° C., such as from 450° C. to 850° C., from 500° C. to 800° C., from 550° C. to 750° C., from 600° C. to 700° C., or from any and all ranges and sub-ranges between the foregoing values. The furnace 212 may be operated with a steam-to-hydrocarbon weight ratio of from 0.3:1 to 2:1, such as from 0.4:1 to 2:1, from 0.3:1 to 3:2, from 1:1 to 2:1, or from any and all ranges and sub-ranges between the foregoing values. The furnace 212 may be operated with a residence time of from 0.05 seconds to 2 seconds.

The cracked products stream 214 may be passed to a second separation unit 216 operable to fractionate the cracked products stream 214, thereby producing a first product stream 272 comprising hydrogen and hydrocarbons having a boiling point of less than or equal to 220° C., and a second product stream 218 comprising hydrocarbons having a boiling point of greater than 220 C. The first product stream 272 may be recycled to the first separation unit 208.

A mixing vessel 220 may be operable to combine a refined feedstock 222 and the second product stream 218 to produce a coker inlet stream 224. The mixing vessel may be any vessel operable to mix the refined feedstock 222, the second product stream 218, or both, to form the coker inlet stream 224. The coker inlet stream 224 may be passed to a coker 226. In other embodiments, the refined feedstock 222 and/or the second product stream 218 may be added directly to the coker 226 (not shown), or may be passed to an intermediary unit for processing prior to reaching the coker 226 (not shown). That is, the coker 226 may be operable to receive the refined feedstock 222, either directly or indirectly from a vessel upstream of the coker 226.

The coker 226 may be any unit operable to convert oil from the refined feedstock and/or residual oil in the second product stream 218 into lower molecular weight hydrocarbon gas, naphtha, light and heavy gas oils, or combinations thereof and solid coke. The coker 226 may be configured to receive and process the refined feedstock 222 thereby producing a first coker product 230 and a second coker product 228 comprising solid coke. The first coker product 230 may be passed to the second separation unit 216, wherein the first coker product 230 may be fractionated into the first product stream 272 comprising hydrogen and hydrocarbons having a boiling point of less than or equal to 220° C., and the second product stream 218 comprising hydrocarbons having a boiling point of greater than 220 C. That is, the first product stream 272 may include both a fraction of the cracked products stream 214 and a fraction of the first coker product 230. Similarly, the second product stream 218 may include a fraction of the cracked products stream 214 and a fraction of the first coker product 230. As noted herein, the first product stream 272 may be recycled to the first separation unit 208, and the second product stream 218 may be recycled to the mixing vessel 220. In embodiments, flue gases may be removed from the coker 226 (not shown).

Referring still to FIG. 2A, the second fraction 236 from the first separation unit 208 may be passed to an upgrading unit 238 operable to process the second fraction 236 and produce a gas stream outlet 240 and an upgraded product stream 244.

The upgrading unit 238 may be any reactor or system operable to convert the butenes and/or $C_{5+}$ hydrocarbons having a boiling point of less than or equal to 220° C. in the second fraction 236 to upgraded hydrocarbon products. For instance, the upgrading unit 238 and/or the operation conditions of the upgrading unit 238 may be selected to optimize production of one or more products, such as maximum olefin production, maximum aromatic production, and/or maximum gasoline production. Such configuration of the upgrading unit 238 may vary depending on the user's desired upgraded product stream 244. Depending on the configuration of the upgrading unit 238, the system 200 may include a gas stream inlet 242, which may include a reaction gas, such as hydrogen gas if the upgrading unit 238 is configured for hydrotreating the second fraction 236. Depending on the configuration of the upgrading unit 238, the system 200 may include a gas stream outlet 240, which may include a gas such as $H_2S$, which may be stored or disposed.

The third fraction 232 from the first separation unit 208 may be passed to a gas steam cracker unit 234 operable to crack the third fraction 232. The gas steam cracker unit 234 may be configured to pass a stream 252 to the first separation unit 208. The stream 252 may include one or more cracked products to be processed in the system 200. In embodiments, the gas steam cracker unit 234 may be configured to receive a separate reactive organic gas stream (not pictured), such as a gas stream comprising methane, ethane, propane, or combinations thereof, which may be recovered in the first separation unit 208.

The fourth fraction 246 comprising methane, hydrogen, $H_2S$, or combinations thereof from the first separation unit 208 may be separated, stored, disposed, or integrated into a separate plant system (not shown).

The fifth fraction 248 comprising light olefins from the first separation unit 208 may be stored or integrated into a separate plant system (not shown).

Figure 2B:
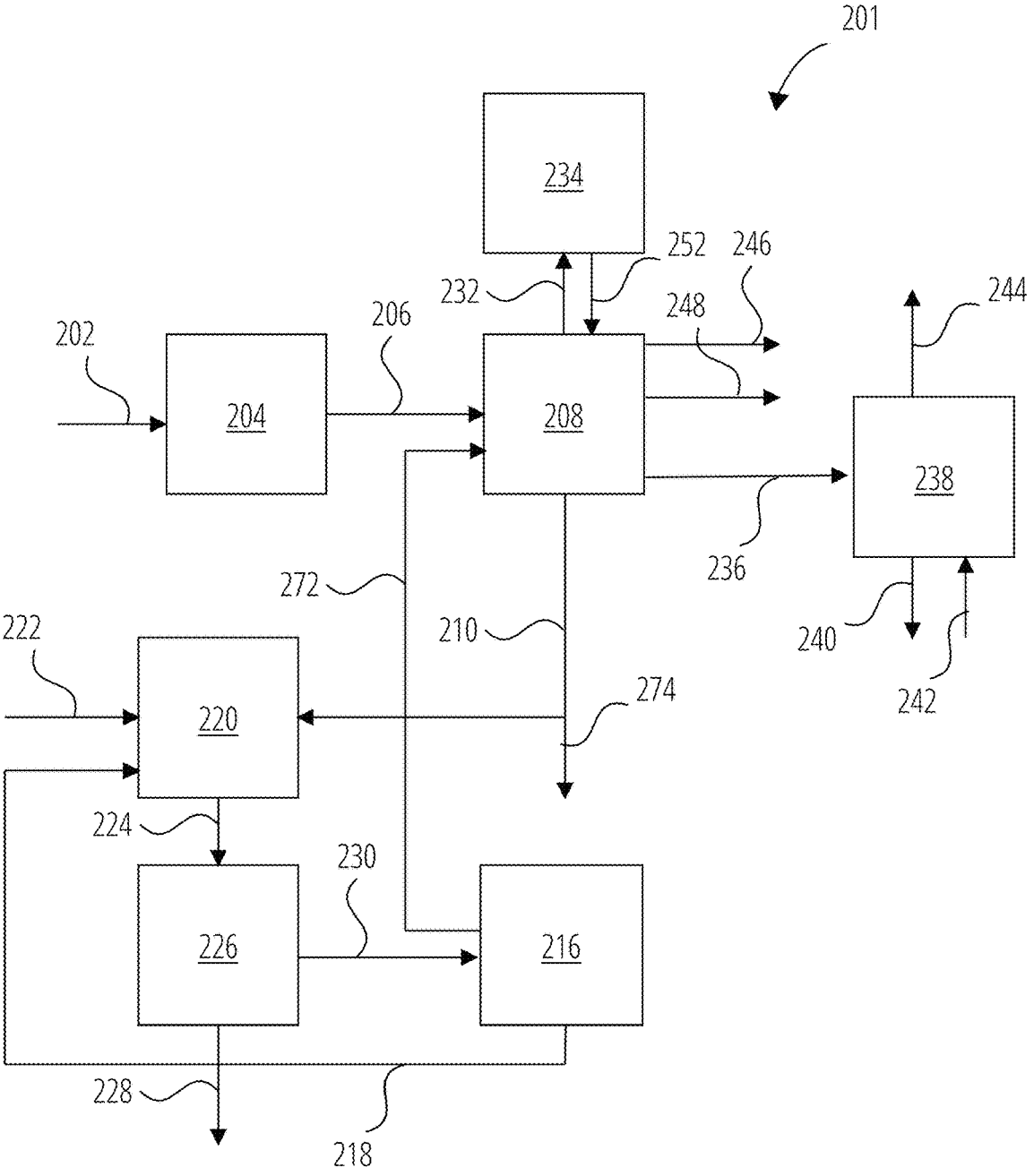
FIG. 2B schematically depicts a system for processing a crude oil feedstock and a refined feedstock comprising vacuum residue, fuel oil, or both, according to embodiments disclosed herein.

Referring now to FIG. 2B, a system 201 for processing a crude oil feedstock 202 and a refined feedstock 222 comprising vacuum residue, fuel oil, or both, is depicted. Any description of like terms used in the context of the method 100, or the system 200 may be applied to the same terms used in the system 201. For instance, any description of the crude oil feedstock in the method 100 may apply to the crude oil feedstock 202 of the system 200. Further, for instance, any description of the first separation unit 208 in system 200 may apply to the first separation unit 208 in system 201.

As shown in FIG. 2B, the system 201 differs from system 200 of FIG. 2A in that the furnace 212 is not included. In system 201 the first fraction 210 may be passed to the mixing vessel 220, which then may be introduced to the coker 226 through the coker inlet stream 224. In other embodiments. The first fraction 210 may be passed directly to the coker 226 (not shown), or may be passed to an intermediary unit for processing prior to reaching the coker 226 (not shown). In embodiments, a stream 274 comprising cracked gas oil, cracked vacuum gas oil, or both may be removed from the first fraction 210 prior to introducing the first fraction 210 to the mixing vessel 220 or the coker 226.

This disclosure includes numerous aspects. One aspect is a method of processing a crude oil feedstock and a refined feedstock comprising vacuum residue and/or fuel oil, the method comprising: cracking the crude oil feedstock in a downflow reaction zone of a fluid catalytic cracking unit to produce a first FCC product; processing the refined feedstock in a coker to produce a first coker product and a second coker product comprising solid coke; and processing at least a portion of the first FCC product and at least a portion of the first coker product in an upgrading unit to produce an upgraded product stream.

Another aspect is any above aspect or combination of aspects, further comprising at least one of: fractionating the first FCC product to produce a first fraction comprising light cycle oil, heavy cycle oil, or combinations thereof; fractionating the first FCC product to produce a second fraction comprising butenes and butanes, $C_{5+}$ hydrocarbons having a boiling point of less than or equal to 220 C, or combinations thereof; fractionating the first FCC product to produce a third fraction comprising ethane, propane, butane, or combinations thereof; fractionating the first FCC product to produce a fourth fraction comprising methane, hydrogen, $H_2S$, or combinations thereof; and fractionating the first FCC product to produce a fifth fraction comprising light olefins.

Another aspect is any above aspect or combination of aspects, further comprising: fractionating the first FCC product to produce a first fraction comprising light cycle oil, heavy cycle oil, or combinations thereof; thermally cracking the first fraction to produce a cracked products stream comprising hydrogen, light olefins, LPG saturates, pyrolysis gasoline pyrolysis fuel oil, or combinations thereof; and passing at least a portion of the cracked products stream to the coker.

Another aspect is any above aspect or combination of aspects, further comprising: fractionating the first FCC product to produce a first fraction comprising light cycle oil, heavy cycle oil, or combinations thereof; and passing the first fraction to the coker.

Another aspect is any above aspect or combination of aspects, further comprising removing cracked gas oil, cracked vacuum gas oil, or both from the first fraction prior to passing the first fraction to the coker.

Another aspect is any above aspect or combination of aspects, wherein the first coker product comprises light gases, coker naphtha, coker gas oil, coke, or combinations thereof.

Another aspect is any above aspect or combination of aspects, further comprising: fractionating the first FCC product to produce a second fraction comprising $C_{4+}$ hydrocarbons having a boiling point of less than or equal to 220 C; and passing at least a portion of the second fraction to the upgrading unit.

Another aspect is any above aspect or combination of aspects, wherein the upgraded product stream comprises olefins, aromatics, gasoline, or a mixture thereof.

Another aspect is any above aspect or combination of aspects, further comprising fractionating the first FCC product to produce a third fraction comprising ethane, propane, butane, or combinations thereof; and steam cracking the third fraction to produce hydrogen, light olefins, LPG saturates, pyrolysis gasoline, pyrolysis fuel oil products, or combinations thereof.

Another aspect is any above aspect or combination of aspects, further comprising: fractionating the first coker product to produce a first coker fraction comprising hydrogen and hydrocarbons having a boiling point of less than or equal to 220° C., and a second coker fraction comprising hydrocarbons having a boiling point of greater than 220° C.; removing at least a portion of the hydrogen from the first coker fraction to produce a hydrogen-depleted first coker product; and passing at least a portion of the hydrogen-depleted first coker product to the upgrading unit.

Another aspect is any above aspect or combination of aspects, further comprising recycling at least a portion of the second coker fraction to the coker.

Another aspect is any above aspect or combination of aspects, further comprising mixing at least a portion of the second coker fraction with the refined feedstock upstream of the coker.

Another aspect is any above aspect or combination of aspects, further comprising separating the second coker product from the first coker product prior to fractionating the first coker product.

Another aspect is any above aspect or combination of aspects, further comprising removing flue gases from the fluid catalytic cracking unit, removing flue gases from the coker, or both.

Another aspect is any above aspect or combination of aspects, wherein the crude oil feedstock comprises Arab light crude oil, Arab extra light crude oil, or combinations thereof.

Another aspect is any above aspect or combination of aspects, wherein the crude oil feedstock has an American Petroleum Institute gravity of greater than or equal to 15 degrees and less than or equal to 50 degrees.

Another aspect is a system for processing a crude oil feedstock and a refined feedstock comprising vacuum residue and/or fuel oil, the system comprising: a dual downer reactor operable to receive the crude oil feedstock; a first separation unit downstream of the dual downer reactor; a coker operable to receive the refined feedstock; a second separation unit downstream of the coker; and an upgrading unit downstream of the first separation unit; wherein: the second separation unit is fluidly connected to the first separation unit; and the first separation unit is fluidly connected to the coker.

Another aspect is any above aspect or combination of aspects, wherein the crude oil feedstock is directly connected to the fluid catalytic cracking unit.

Another aspect is any above aspect or combination of aspects, wherein the refined feedstock is directly connected to the dual downer reactor.

Another aspect is any above aspect or combination of aspects, further comprising a furnace downstream of the first separation unit and upstream of the second separation unit.

Another aspect is any above aspect or combination of aspects, wherein the first separation unit is directly connected to the coker or is directly connected to a mixing vessel that is directly connected to the coker.

Another aspect is any above aspect or combination of aspects, wherein the coker is configured to receive a recycle stream from the second separation unit.

Another aspect is any above aspect or combination of aspects, wherein the first separation unit is configured to receive a recycle stream from the second separation unit.

Another aspect is any above aspect or combination of aspects, further comprising a steam cracking unit fluidly connected to the first separation unit.

It will be apparent to persons of ordinary skill in the art that various modifications and variations can be made without departing from the scope disclosed herein. Since modifications, combinations, sub-combinations, and variations of the disclosed embodiments, which incorporate the spirit and substance disclosed herein, may occur to persons of ordinary skill in the art, the scope disclosed herein should be construed to include everything within the scope of the appended claims and their equivalents.

For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" or "consists essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

It should be understood that any two quantitative values assigned to a property may constitute a range of that property, and all combinations of ranges formed from all stated quantitative values of a given property are contemplated in this disclosure. The subject matter disclosed herein has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A method of processing a crude oil feedstock and a refined feedstock comprising vacuum residue and/or fuel oil, the method comprising:

cracking the crude oil feedstock in a downflow reaction zone of a fluid catalytic cracking unit to produce a first FCC product;

processing the refined feedstock in a coker to produce a first coker product and a second coker product comprising solid coke; and processing at least a portion of the first FCC product and at least a portion of the first coker product in an upgrading unit to produce an upgraded product stream.

2. The method of claim 1, further comprising at least one of:

fractionating the first FCC product to produce a first fraction comprising light cycle oil, heavy cycle oil, or combinations thereof;

fractionating the first FCC product to produce a second fraction comprising butenes and butanes, $C_{5+}$ hydrocarbons having a boiling point of less than or equal to 220 C, or combinations thereof;

fractionating the first FCC product to produce a third fraction comprising ethane, propane, butane, or combinations thereof;

fractionating the first FCC product to produce a fourth fraction comprising methane, hydrogen, $H_2S$, or combinations thereof; and fractionating the first FCC product to produce a fifth fraction comprising light olefins.

3. The method of claim 1, further comprising:

fractionating the first FCC product to produce a first fraction comprising light cycle oil, heavy cycle oil, or combinations thereof;

thermally cracking the first fraction to produce a cracked products stream comprising hydrogen, light olefins, LPG saturates, pyrolysis gasoline pyrolysis fuel oil, or combinations thereof; and passing at least a portion of the cracked products stream to the coker.

4. The method of claim 1, further comprising:

fractionating the first FCC product to produce a first fraction comprising light cycle oil, heavy cycle oil, or combinations thereof; and passing the first fraction to the coker.

5. The method of claim 4, further comprising removing cracked gas oil, cracked vacuum gas oil, or both from the first fraction prior to passing the first fraction to the coker.

6. The method of claim 1, wherein the first coker product comprises light gases, coker naphtha, coker gas oil, coke, or combinations thereof.

7. The method of claim 1, further comprising:

fractionating the first FCC product to produce a second fraction comprising $C_{4+}$ hydrocarbons having a boiling point of less than or equal to 220 C; and passing at least a portion of the second fraction to the upgrading unit.

8. The method of claim 1, wherein the upgraded product stream comprises olefins, aromatics, gasoline, or a mixture thereof.

9. The method of claim 1, further comprising fractionating the first FCC product to produce a third fraction comprising ethane, propane, butane, or combinations thereof; and steam cracking the third fraction to produce hydrogen, light olefins, LPG saturates, pyrolysis gasoline, pyrolysis fuel oil products, or combinations thereof.

10. The method of claim 1, further comprising:

fractionating the first coker product to produce a first coker fraction comprising hydrogen and hydrocarbons having a boiling point of less than or equal to 220° C., and a second coker fraction comprising hydrocarbons having a boiling point of greater than 220° C.;

removing at least a portion of the hydrogen from the first coker fraction to produce a hydrogen-depleted first coker product; and passing at least a portion of the hydrogen-depleted first coker product to the upgrading unit.

11. The method of claim 10, further comprising at least one of:

recycling at least a portion of the second coker fraction to the coker; and separating the second coker product from the first coker product prior to fractionating the first coker product.

12. The method of claim 11, further comprising mixing at least a portion of the second coker fraction with the refined feedstock upstream of the coker.

13. The method of claim 1, wherein the crude oil feedstock comprises Arab light crude oil, Arab extra light crude oil, or combinations thereof.

14. The method of claim 1, wherein the crude oil feedstock has an American Petroleum Institute gravity of greater than or equal to 15 degrees and less than or equal to 50 degrees.

15. A system for processing a crude oil feedstock and a refined feedstock comprising vacuum residue and/or fuel oil, the system comprising:

a dual downer reactor operable to receive the crude oil feedstock;

a first separation unit downstream of the dual downer reactor;

a coker operable to receive the refined feedstock;

a second separation unit downstream of the coker; and an upgrading unit downstream of the first separation unit; wherein:

the second separation unit is fluidly connected to the first separation unit; and the first separation unit is fluidly connected to the coker.

16. The system of claim 15, wherein the crude oil feedstock is directly connected to the fluid catalytic cracking unit.

17. The system of claim 15, further comprising a furnace downstream of the first separation unit and upstream of the second separation unit.

18. The system of claim 15, wherein the first separation unit is directly connected to the coker or is directly connected to a mixing vessel that is directly connected to the coker.

19. The system of claim 15, wherein the coker is configured to receive a recycle stream from the second separation unit.

20. The method of claim 1, further comprising fractionating the first coker product to produce a first coker fraction comprising hydrogen and hydrocarbons having a boiling point of less than or equal to 220° C., and processing the first coker product in the upgrading unit.

* * * * *